US009394124B2

(12) United States Patent
Tsuji et al.

(10) Patent No.: US 9,394,124 B2
(45) Date of Patent: Jul. 19, 2016

(54) SHEET INSERT DEVICE, SHEET PROCESSING APPARATUS AND SHEET PROCESSING METHOD

(71) Applicant: Kabushiki Kaisha Toshiba, Tokyo (JP)

(72) Inventors: Iwao Tsuji, Tokyo (JP); Kazuhiro Mukai, Kawasaki (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 14/534,872

(22) Filed: Nov. 6, 2014

(65) Prior Publication Data

US 2015/0132088 A1 May 14, 2015

(30) Foreign Application Priority Data

Nov. 11, 2013 (JP) ..... 2013-233556

(51) Int. Cl.

| | |
|---|---|
| ***B65H 1/14*** | (2006.01) |
| ***B65H 31/26*** | (2006.01) |
| ***B65H 33/00*** | (2006.01) |
| ***B65H 43/00*** | (2006.01) |
| ***G07D 7/12*** | (2016.01) |

(Continued)

(52) U.S. Cl.

CPC ..... *B65H 1/14* (2013.01); *B65H 1/027* (2013.01); *B65H 1/30* (2013.01); *B65H 31/26* (2013.01); *B65H 33/00* (2013.01); *B65H 43/00* (2013.01); *G07D 7/12* (2013.01); *B65H 2405/332* (2013.01); *B65H 2701/1912* (2013.01)

(58) Field of Classification Search

CPC ..... B65H 1/08; B65H 1/14; B65H 1/027; B65H 1/30; B65H 31/26; B65H 33/00; B65H 43/00; B65H 2405/332; B65H 2701/1912; G07D 7/12

USPC ..... 414/795.8, 796, 796.5; 271/118, 121, 271/147, 153

See application file for complete search history.

(56) References Cited

U.S. PATENT DOCUMENTS 4,498,381 A * 2/1985 Convey, Jr. ..... B65H 31/26 100/100
4,538,511 A * 9/1985 Wise ..... B65B 27/08 100/26

(Continued)

FOREIGN PATENT DOCUMENTS

| | | |
|---|---|---|
| DE | 102007043129 A1 | 3/2009 |
| EP | 2196419 A2 | 6/2010 |
| JP | 2001-163457 A | 6/2001 |

OTHER PUBLICATIONS

European Search Report in related European Patent Application No. EP14192438, issued on May 15, 2015 (6 pages).

*Primary Examiner* — Dean Kramer
(74) *Attorney, Agent, or Firm* — Baker Botts L.L.P.

(57) ABSTRACT

According to one embodiment, a sheet insert device includes a cassette having a plurality of containing portions each of which contains a plurality of sheets in a vertically stacked state, a moving structure to move the cassette so that the plurality of containing portions are arranged in turn at a pulling-out position, a grip arm to grip the plurality of sheets contained in the containing portion arranged at the pulling-out position in the stacking direction, and a transferring structure which moves the grip arm, to pull out the plurality of sheets at the pulling-out position which are gripped by the grip arm from the containing portion, and transfers the plurality of sheets to a sheet loading part without changing the posture.

17 Claims, 15 Drawing Sheets

(51) Int. Cl.
*B65H 1/02* (2006.01)
*B65H 1/30* (2006.01)

(56) References Cited

U.S. PATENT DOCUMENTS 4,658,715 A * 4/1987 Stobb ..... B65G 57/035 100/2
5,101,979 A * 4/1992 Uno ..... G07D 11/0018 209/534
5,803,446 A * 9/1998 Leuthold ..... B65H 1/30 271/159
6,398,107 B1 * 6/2002 Neri ..... B65H 31/3054 235/379
6,543,762 B1 * 4/2003 Quadalti ..... B65H 1/30 221/11
7,469,890 B2 * 12/2008 Aoki ..... B65H 1/02 271/149
8,142,133 B2 * 3/2012 Neebe ..... B07C 3/00 271/2
2012/0175217 A1 7/2012 Demmeler

* cited by examiner

SHEET INSERT DEVICE, SHEET PROCESSING APPARATUS AND SHEET PROCESSING METHOD

CROSS-REFERENCE TO RELATED APPLICATION

This application is based upon and claims the benefit of priority from Japanese Patent Application No. 2013-233556, filed on Nov. 11, 2013; the entire contents of which are incorporated herein by reference.

FIELD

Embodiments described herein relate generally to a sheet insert device, a sheet processing system and a sheet processing method which collectively insert a plurality of sheets in a stacked state.

BACKGROUND

A banknote processor to collect and process banknotes which have been circulated in the market has a sheet loading part into which a plurality of loose banknotes are collectively inserted, and has an inspection portion which takes out inserted banknotes on a transport path one by one, and inspects the taken-out sheet. This processor sorts each banknote into a recirculatable banknote (a fit note), a non-recirculatable banknote (an unfit note), and a counterfeit note and a non-determinable banknote (a rejected note), and stacks the sorted banknotes.

A banknote processor is known, which is provided with a sheet loading part near a takeout portion, so that a plurality of banknotes to be processed next can be inserted, while the banknote processor takes out a plurality of inserted banknotes.

However, in the above-described conventional banknote processor, since a plurality of loose banknotes are inserted by manual work of an operator, much time has been required, and large work burden has been required. In addition, since banknotes are inserted by manual work, the banknotes might be fallen sometimes.

Accordingly, development of a sheet insert device and a sheet processing apparatus which can reduce the work burden by an operator and can surely insert sheets has been desired.

DETAILED DESCRIPTION

According to one embodiment, there is provided a sheet insert device including: a cassette having a plurality of containing portions each of which contains a plurality of sheets in a vertically stacked state; a moving structure to move the cassette so that the plurality of containing portions are arranged in turn at a pulling-out position; a grip arm to grip the plurality of sheets contained in the containing portion arranged at the pulling-out position in the stacking direction; and a transferring structure which moves the grip arm, to pull out the plurality of sheets at the pulling-out position which are gripped by the grip arm from the containing portion, and transfers the plurality of sheets to a sheet loading part without changing the posture.

Further, according to one embodiment, there is provided a sheet processing method including: housing a plurality of sheets in a stacked state in respective containing portions of a plurality of the containing portions formed in a cassette; moving the cassette so that the plurality of containing portions are arranged in turn at a pulling-out position; gripping the plurality of sheets contained in the containing portion arranged at the pulling-out position in a stacking direction by a grip arm; and moving the grip arm which has gripped the sheets, to pull out the plurality of sheets at the pulling-out position which are gripped by the grip arm from the containing portion, and transferring the plurality of sheets to a sheet loading part without changing the posture.

Hereinafter, embodiments will be described in detail with reference to the drawings. Here, before describing a sheet insert device 100 (hereinafter, referred to simply as an insert device 100) according to an embodiment, an example of a sheet processing apparatus 1 (hereinafter, referred to simply as a processing apparatus 100) according to the embodiment which receives the insertion of a sheet P by this insert device 100 will be described with reference to FIG. 1 to FIG. 4.

Figure 1:
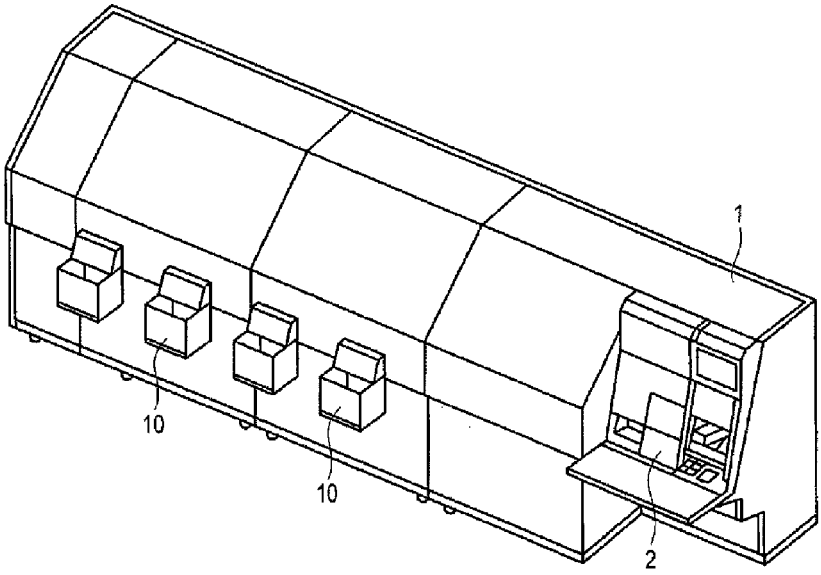
FIG. 1 is an appearance perspective view showing an example of a sheet processing apparatus according to an embodiment.
Figure 2:
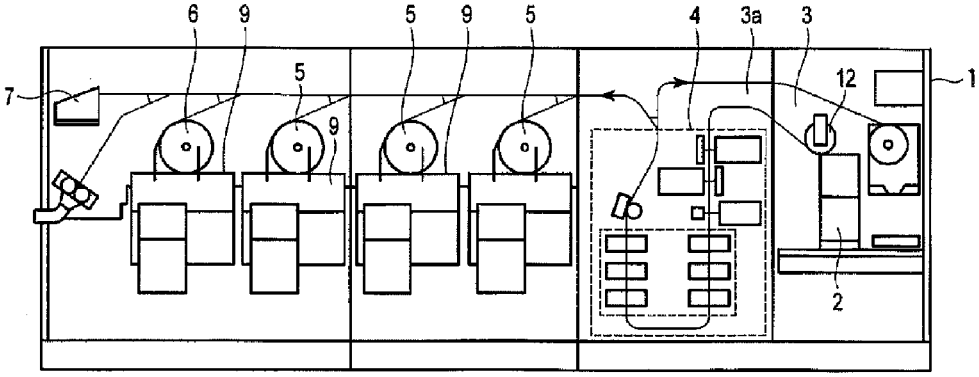
FIG. 2 is a schematic diagram showing an internal configuration of the sheet processing apparatus of FIG. 1.

FIG. 1 is an appearance perspective view of the processing apparatus 1, and FIG. 2 is a schematic diagram showing an internal configuration of this processing apparatus 1. This processing apparatus 1 inspects a sheet P such as a banknote by various detection devices, and sorts the sheet P into a recirculatable sheet (a fit note), a non-recirculatable sheet (an unfit note), and a rejected note (a counterfeit note, or a detection non-determinable note).

The processing apparatus 1 has a sheet loading part 2 for collectively inserting a prescribed number of loose sheets P, at a front near the end portion at the right-hand side seen by an operator. In the present embodiment, one thousand loose sheets P (hereinafter referred to as loose sheets) which are not strapped but in a stacked state are inserted at one time by an operator through the sheet loading part 2. The insert device 100 described later is arranged adjacent to the processing apparatus 1, and is connected to this sheet loading part 2

The processing apparatus 1 has a feeder rotor 12 which collectively moves the plurality of sheets P inserted through the sheet loading part 2 to a takeout portion, and takes out the sheets P in order from the sheet P at the upper end in the stacking direction on a transport path 3*a*. The processing apparatus 1 further has a conveying structure 3 to convey the sheet taken out on the transport path 3*a* by the feeder rotor 12.

On the transport path 3*a*, various inspection portions 4 each of which inspects a state of the sheet P to be conveyed, and fit note stackers 5 and unfit note stackers 6 each of which sorts and stacks the sheets P for each 100 sheets based on the inspection result, are provided. In addition, at the terminal of the transport path 3*a*, a rejected note stacker 7 so as to stack a rejected sheet is provided.

At each of the downstream sides of the fit note stackers 5 and the unfit note stackers 6 in the conveying direction, a strapping unit 9 is provided which straps the sheets by winding a band on the sheets of a 100-sheet unit which are sent from each of the stackers 5, 6. In each of the strapping units 9, a pusher (not shown) to discharge a strapped bundle outside the apparatus is provided. At the front side of the processing apparatus 1, takeout boxes 10 . . . each of which receives the strapped bundle discharged outside the apparatus by the pusher, are provided.

Figure 3:
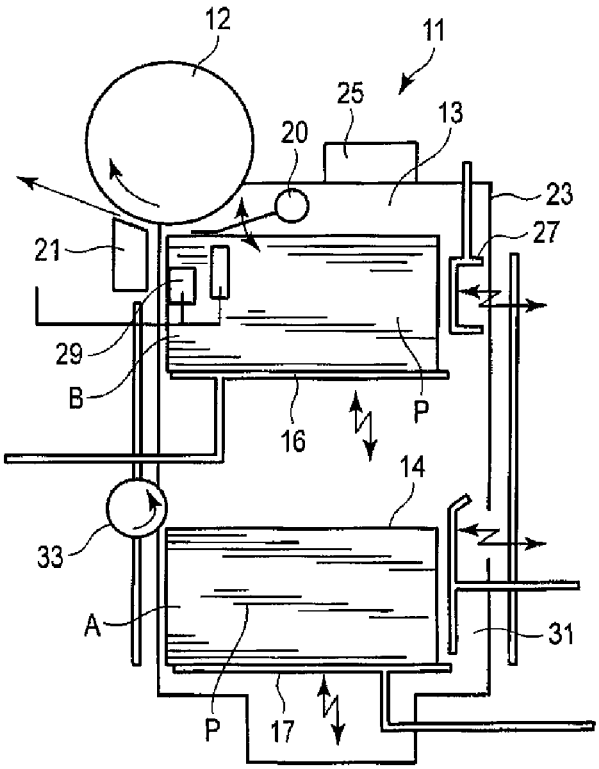
FIG. 3 is a front view showing a supply/feeder device incorporated in the sheet processing apparatus of FIG. 1.
Figure 4:
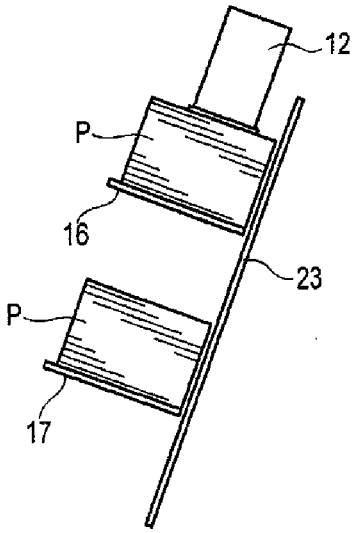
FIG. 4 is a side view of the supply/feeder device of FIG. 3 which is seen from the upstream side in the sheet takeout direction.

FIG. 3 is a front view schematically showing a supply/feeder device 11 which is incorporated in the sheet loading part 2 of the above-described processing apparatus 1, and FIG. 4 is a side view of the supply/feeder device 11 seen from the back side (downstream side) in the takeout direction of the sheet P. The supply/feeder device 11 includes the above-described feeder rotor 12.

The supply/feeder device 11 has first and second feeder paddle units 13, 14 each of which receives a plurality of the sheets P in a vertically stacked state alternately, and feeds the received sheets P toward the feeder rotor 12. The loose sheets in the state that 1000 sheets P are vertically stacked are inserted into each of the first and second feeder paddle units 13, 14.

The first and second feeder paddle units 13, 14 are configured to be in mirror symmetry in the horizontal direction, and during the feeding operation of the sheets P by one unit, the other unit becomes in a state capable of accepting the insertion of loose sheets by an operator.

For example, when the first feeder paddle unit 13 is arranged at a takeout position B near the feeder rotor 12 and feeds the sheet P, the second feeder paddle unit 14 is arranged at a receiving position A, and enables the loose sheets to be inserted. On the contrary, when the second feeder paddle unit 14 is arranged at the takeout position B, and feeds the sheet P, the first feeder paddle unit 13 is arranged at the receiving position A, and enables the loose sheets to be inserted.

The first and second feeder paddle units 13, 14 are elevatably provided with first and second feeder paddles 16, 17, respectively. After having received loose sheets at the receiving position A at the lower side of the sheet loading part 2, each of the first and second feeder paddles 16, 17 operates so as to convey the loose sheets to the takeout position B at the upper side. The first and second feeder paddles 16, 17 operate so that they are replaced alternately, and do not interfere with each other.

A feed controller 20 to detect an upper limit position of loose sheets, and a vacuum chamber 21 to prevent double-note feeding so as to prevent double-note feeding of the sheets P are arranged near the lower portion side of the feeder rotor 12. The vacuum chamber 21 to prevent double-note feeding has an opening to face the circumferential face of the feeder rotor 12, and sucks air through this opening, absorbs the second and subsequent sheets P which are to be taken out together by the first sheet P, and thereby separates the second and subsequent sheets P from the first sheet P.

At the back face side of the supply/feeder device 11, a guide portion 23 which functions as alignment means is provided. The guide portion 23 faces the trail edge sides in the direction orthogonal to the takeout direction of the loose sheets (left direction in FIG. 3), that is the trail edge sides in the wide direction.

The guide portion 23 is provided so that the upper end thereof is tilted to the back face side at an angle of 15°, as shown in FIG. 4. And, the first or second feeder paddle 16, 17 is arranged at right angles to the guide portion 23. Accordingly, the loose sheets loaded on the first or second feeder paddle 16, 17 slide by the self-weight, and the trail edge sides are made to contact to the guide portion 23, and by this means, the wide direction of the loose sheets is aligned, and thereby the reference position can be determined.

At the upper portion side of the guide portion 23, a keeping structure 25 to hold the upper end of the guide portion 23. This keeping structure 25 functions so as to prevent the deflection of the guide portion 23. The guide portion 23 has a tilt angle of 75° to the horizontal plane.

At the upper portion side of the supply/feeder device 11, a trail-edge guide structure 27 as regulating means to face the trail edges in the takeout direction of the loose sheets sent to the takeout position B, that is the trail edge sides in the longitudinal direction. This trail-edge guide structure 27 regulates the behavior of the sheets P at the time of taking out the sheets P.

In addition, at the upper portion side of the supply/feeder device 11, a long edge alignment structure 29 which is located at the lower portion of the feeder rotor 12 and faces the front edge sides of the loose sheets sent to the takeout position B in the direction orthogonal to the takeout direction, that is the front edge sides in the wide direction. The long edge alignment structure 29 aligns the wide direction of the loose sheets, and separates the loose sheets by blowing air to the loose sheets.

In addition, at the lower portion side of the supply/feeder device 11, a trail-edge alignment structure 31 is provided which faces the trail edge sides in the takeout direction of the loose sheets loaded on the feeder paddle 16 (17) at the receiving position A, that is the trail edge sides in the longitudinal direction. When a reserve switch is pushed, this trail-edge alignment structure 31 operates so as to automatically and forcibly align the loose sheets loaded on the feeder paddle 16 (17).

In addition, at the lower portion side of the supply/feeder device 11, a pre-unstacking device 33 is provided which faces the front edge sides in the longitudinal direction of the loose sheets loaded on the feeder paddle 16 (17) at the receiving position A. The pre-unstacking device 33 operates so as to separate the loose sheets in accordance with the rising of the feeder paddle 16 (17). That is, in the pre-unstacking device 33, a roller which contacts the front edge sides of the loose sheets in the longitudinal direction rotates in accordance with the rising of the feeder paddle 16 (17), and the rotating roller scratches the front edge sides of the loose sheets, to separate the loose sheets which firmly attach to each other. This is an operation to separate the loose sheets.

Next, the insert device 100 which inserts loose sheets to the receiving position A of the above-described processing apparatus 1 will be described with reference to FIG. 5 to FIG. 21. In the following description, a front-back direction, a horizontal direction, and a vertical direction seen by an operator facing the insert device 100 are respectively determined as an X direction, a Y direction, and a Z direction. In addition, this insert device 100 has a reference plane which tilts toward the back face side of the device, in accordance with the tilted guide portion 23 for determining the reference position of the loose sheets to be inserted into the processing apparatus 1.

Figure 5:
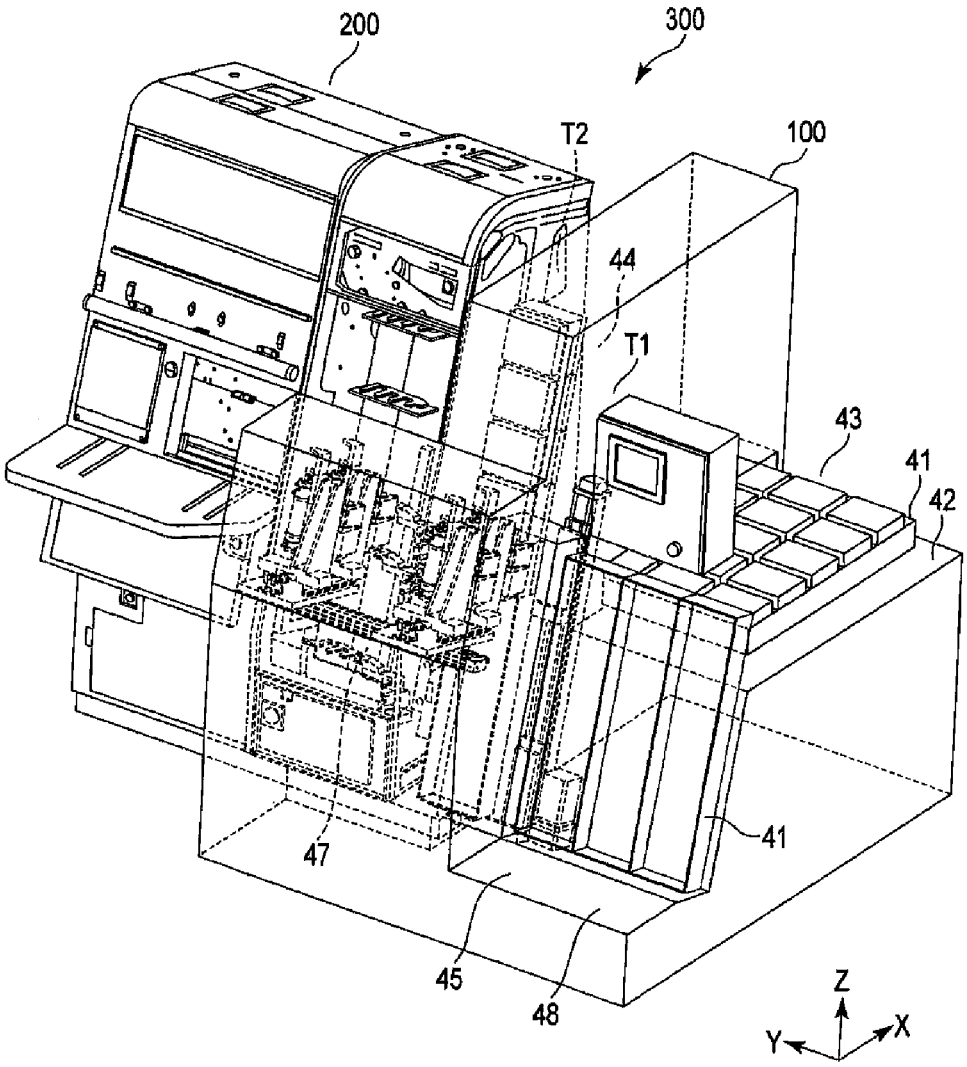
FIG. 5 is an appearance perspective view showing a sheet insert device according to the embodiment.

FIG. 5 is an appearance perspective view showing a system 300 in which the insert device 100 according to the present embodiment is arranged adjacent to a processing apparatus 200 of a type different from the above-described processing apparatus 1. The processing apparatus 200 of this system 300 has an inserting slot A (receiving position A) to which loose sheets are inserted, similarly as the above-described processing apparatus 1, and has the first and second feeder paddle units 13, 14 (here, the illustration and detailed description thereof will be omitted) each of which feeds the loose sheets which have been alternately inserted through the inserting slot A to the takeout position B.

The insert device 100 has a cassette 41 which can house loose sheets of about 5000 sheets, a conveying structure 43 to convey a plurality of the cassettes 41 placed on an insert table 42 (receiving portion) to an inverted position T1 in order, an inverting structure 44 to raise the cassette 41 conveyed to the inverted position T1 at an angle of about 75° to the horizontal plane, a moving structure 45 to move the cassette 41 raised to an uprising position T2 obliquely downward along a sustain frame 55 of the inverting structure 44, a grip arm 46 (FIGS. 20, 21) to grip the loose sheets contained in each of containing portions 51 (FIG. 6) of the cassette 41 in the stacking direction of the sheets P, and a transferring structure 47 which moves the grip arm 46, pulls out the loose sheets gripped by this grip arm 46 from the containing portion 51, and transfers the loose sheets to the sheet loading part 2 (receiving position A) of the processing device 200, without changing the posture.

Figure 6:
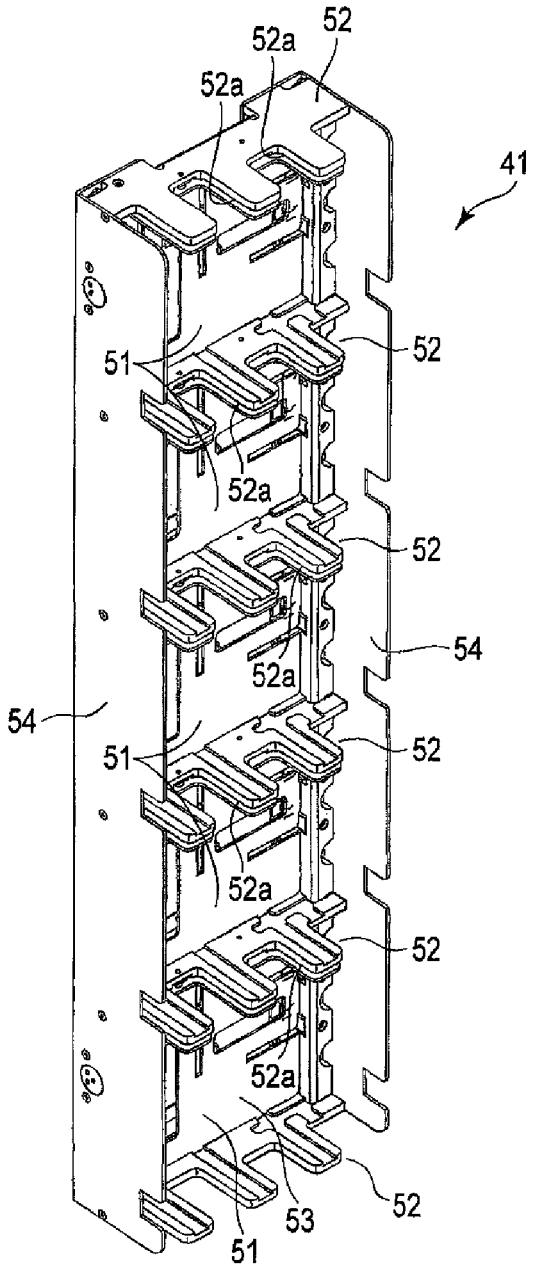
FIG. 6 is an appearance perspective view showing the cassette used in the sheet insert device of FIG. 5.
Figure 7:
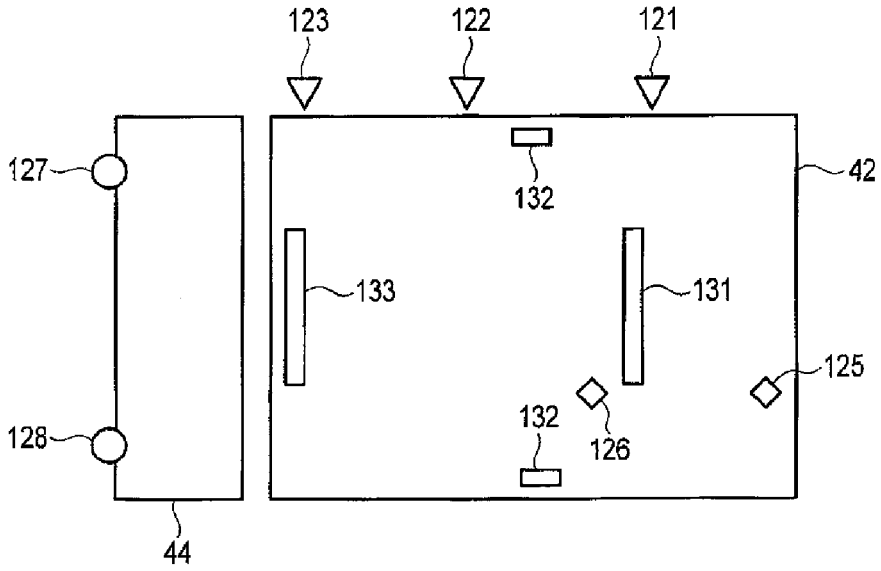
FIG. 7 is a diagram for explaining an operation of the conveying structure of the sheet insert device of FIG. 5.

As shown in FIG. 6, the cassette 41 has five containing portions 51 . . . which are arranged in a line. The five containing portions 51 . . . are partitioned by six partition plates 52. Out of the six partition plates 52, the two partition plates 52 at the both ends of the cassette 41 in the longitudinal direction respectively function as end plates. The cassette 41 has a slender backboard 53 and two slender side panels 54, 54. The backboard 53 and the side panels 54 are assembled in a U-shaped cross section shape. The five containing portions 51 . . . are aligned in the longitudinal direction of the backboard 53 and the two side panels 54, 54. In addition, each of the six partition plates 52 . . . has a cutout 52*a* of a comb teeth shape to pass a claw 46*a* of the grip arm 46 described later in the state of a nest.

In the case of housing loose sheets in each of the containing portion 51 of the cassette 41, the cassette 41 is arranged on a work bench (not shown) in a posture that the opening of each of the containing portions 51 faces upward by making the backboard 53 face the work bench. And the loose sheets are housed in each of the containing portions 51 in an uprising posture that the sheets P at the both ends of the loose sheets in the stacking direction respectively face the partition plates 52 of the both sides of each of the containing portions 51, and one edge side of each of the sheets P in the wide direction faces the backboard 53. At this time, the both edge sides of each of the sheets P of the loose sheets in the longitudinal direction respectively face the side panels 54, 54.

In this manner, loose sheets are housed in the five containing portions 51 in the state that the cassette is tilted, and thereby the sheets P can be housed in an uprising state (uprising state), and it is possible to improve workability. In addition, by this means, the malfunction that a sheet P falls off at the time of housing loose sheets can be reduced. In addition, even if a sheet P falls off at the time of housing loose sheets, since the working is performed on the work bench, it is possible to immediately pick up and house again the sheet P. In addition, when loose sheets are housed in the cassette 41 in the state that the cassette 41 is tilted as in this manner, the cassette 41 can be carried to the insert table 42 in the posture without change, and thereby it is possible to improve workability.

The conveying structure 43 which operates as shown in FIG. 5 is provided at the insert table 42. As shown in FIG. 5, the cassettes 41 are loaded on the insert table 42 side by side in such a posture that the longitudinal direction of the cassette 41 faces the front-back of the device, and the opening of each of the containing portions 51 faces upward. And a plurality of the cassettes 41 are conveyed in the alignment direction (the wide direction of the cassette 41) by the conveying structure 43, and fed to the inverted position T1 in order. The configuration and operation of this conveying structure 43 will be described in detail later.

Figure 18:
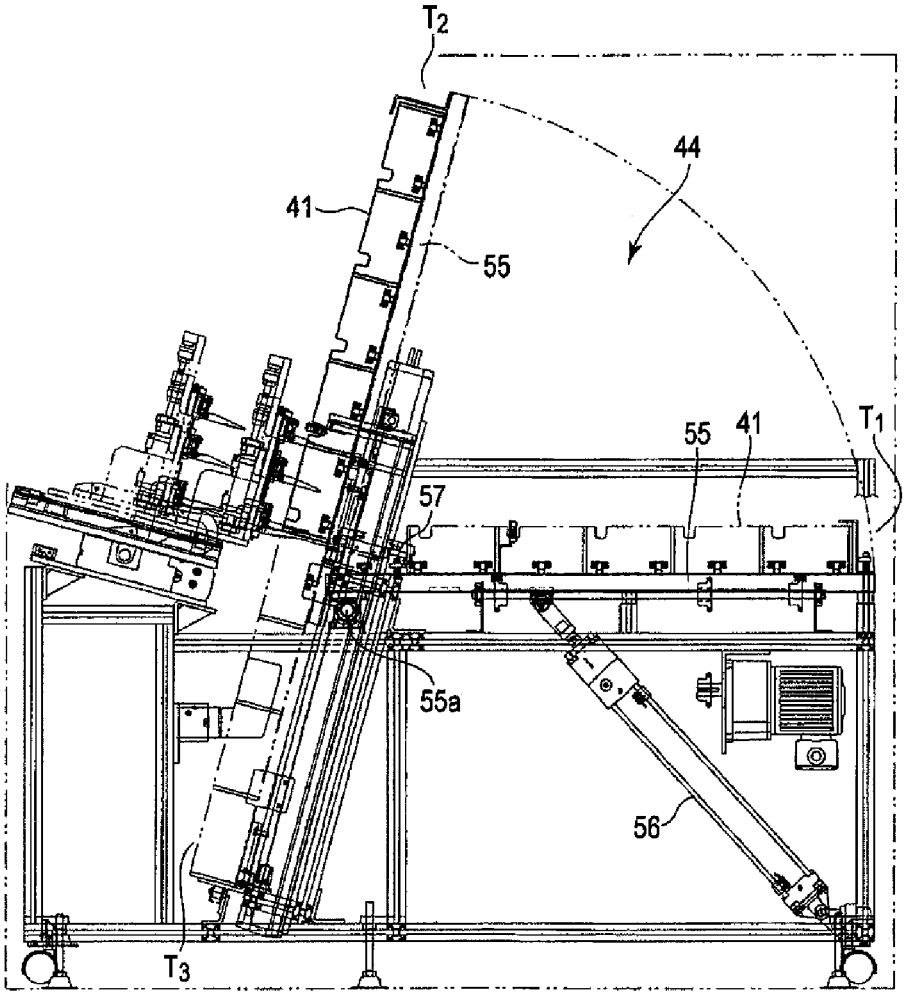
FIG. 18 is a side view showing the inverting structure of the sheet insert device of FIG. 5.

As shown in FIG. 18, the inverting structure 44 has the slender plate-shaped sustain frame 55 which makes contact with the backboard 53 of the cassette 41 that has been conveyed to the inverted position T1, to load the cassette 41, and slidably sustains the relevant cassette 41 along the longitudinal direction. Near the left end (front face side of the device) of the sustain frame 55 in the drawing, a rotary shaft 55*a* to rotatably sustain the sustain frame 55 is provided.

An air cylinder 56 is rotatably attached at one end to the back face side near a central portion of the sustain frame 55. This air cylinder 56 is operated, to cause the sustain frame 55 to be rotatable between the approximately horizontal loading position T1 shown by a solid line in FIG. 18, and the uprising position T2 shown by a dashed line in FIG. 18. In addition, the cassette 41 which has been conveyed to the inverted position T1 by the conveying structure 43 is loaded on the sustain frame 55 arranged at the loading position T1 in an approximately horizontal state along the insert table 42.

A stopper 57 is provided near the lower end of the sustain frame 55, that is near the rotary shaft 55*a*, in the state that the sustain frame 55 is rotated to the uprising position T2. The stopper 57 is provided projectably and retractably from and into the loading face side of the sustain frame 55, and functions so as to engage with the lower end of the cassette 41 to sustain the sustain frame 55, at the time of rotating the sustain frame 55 from the loading position T1 to the uprising position T2. It is possible to prevent the cassette 41 from sliding down by gravity by this stopper 57, during the operation of raising the sustain frame 55.

When the cassette 41 is rotated to the uprising position T2 by the inverting structure 44, the loose sheets contained in each of the containing portions 51 receive gravity along the stacking direction of the sheets P. For this reason, the loose sheets contained in each of the containing portions 51 are slightly compressed in the stacking direction of the sheets P by the own weight. At this time, the partition plate 52 located at the lower end of each of the containing portions 51 functions as a bottom wall of each of the containing portions 51, and sustains the loose sheets contained in the containing portion 51.

Figure 19:
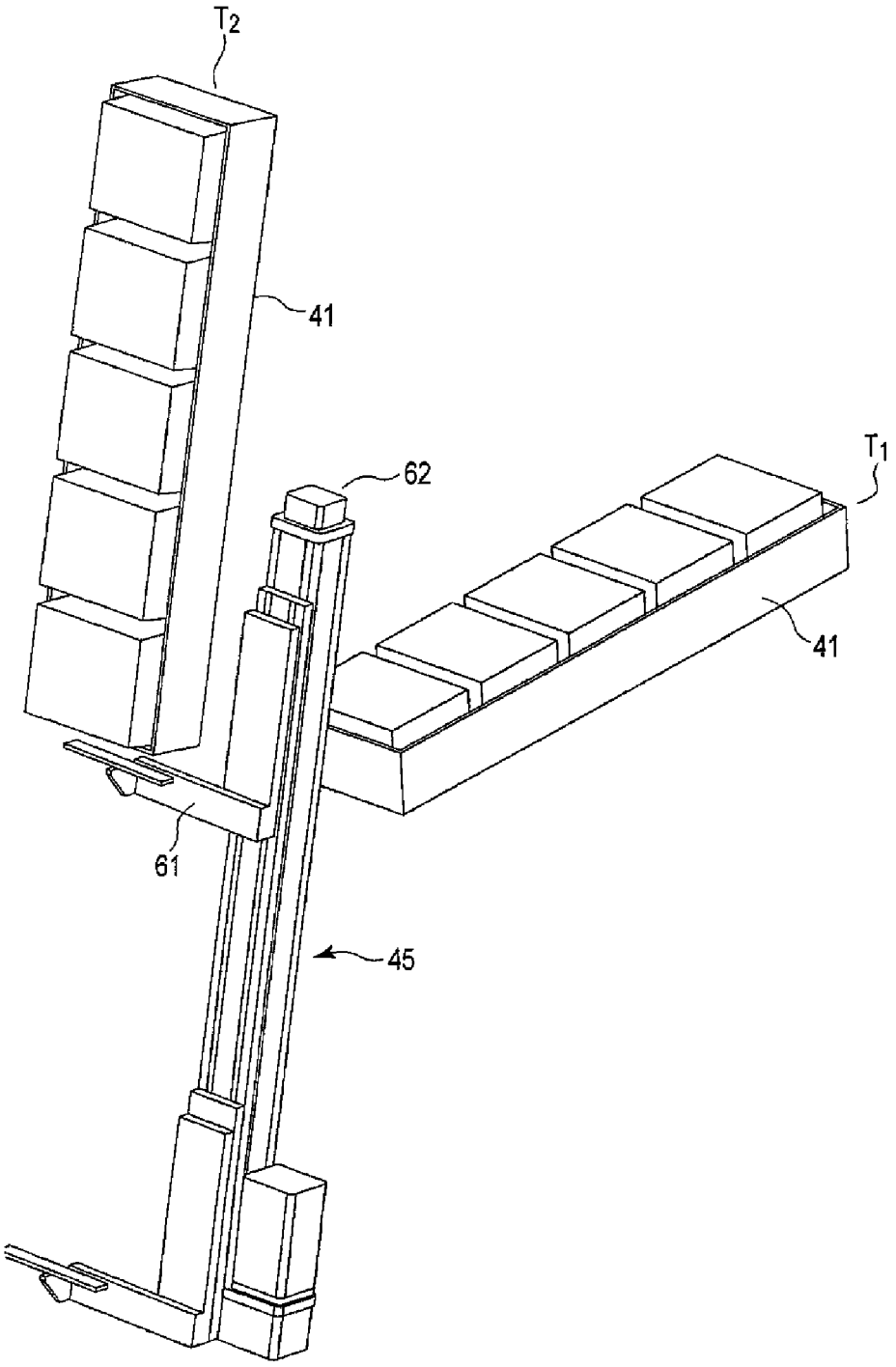
FIG. 19 is a schematic perspective view showing the moving structure of the sheet insert device of FIG. 5.

As shown in FIG. 19, the moving structure 45 has a sustain arm 61 which engages with the partition plate 52 located at the lower end of the cassette 41 which has been raised from the approximately horizontal posture (a first posture) to a posture (a second posture) tilted at an angle of 75° by the inverting structure 44, to thereby sustain the cassette 41, and a lifting and lowering device 62 which lifts and lowers this sustain arm 61 along the slope of 75°. The sustain arm 61 is arranged at a position to face the lower end of the relevant cassette 41 in the state that the cassette 41 is arranged at the uprising position T2 by the inverting structure 44. This moving structure 45 functions so as to receive the cassette 41 which has been raised to the uprising position T2 by the inverting structure 44, and to lower the cassette 41 along the sustain frame 55. Furthermore, in FIG. 19, the illustration of the sustain frame 55 which sustains the cassette 41 is omitted.

The sustain arm 61 stands by at a position close to the lower end of the cassette 41 when the cassette 41 is arranged to the uprising position T2, and receives the cassette 41 which slightly falls when the cassette 41 is released from the sustainment by the stopper 57 of the inverting structure 44. And the sustain arm 61 is intermittently moved to a lower position T3 by the lifting and lowering device 62.

While the cassette 41 is intermittently moved from the uprising position T2 to the lower position T3, the loose sheets contained in each of the containing portions 51 are taken out by the grip arm 46 and the transferring structure 47, and thereby the cassette 41 becomes empty. The cassette 41 which becomes empty in this manner is pushed out sideward (to right side in FIG. 5) from the lower position T3 to a cassette discharger 48 (FIG. 5) by a pusher not shown here. After this, the sustain arm 61 is lifted to the stand-by position to receive the cassette 41 which is to be arranged next at the uprising position T2, by the lifting and lowering device 62.

Figure 20:
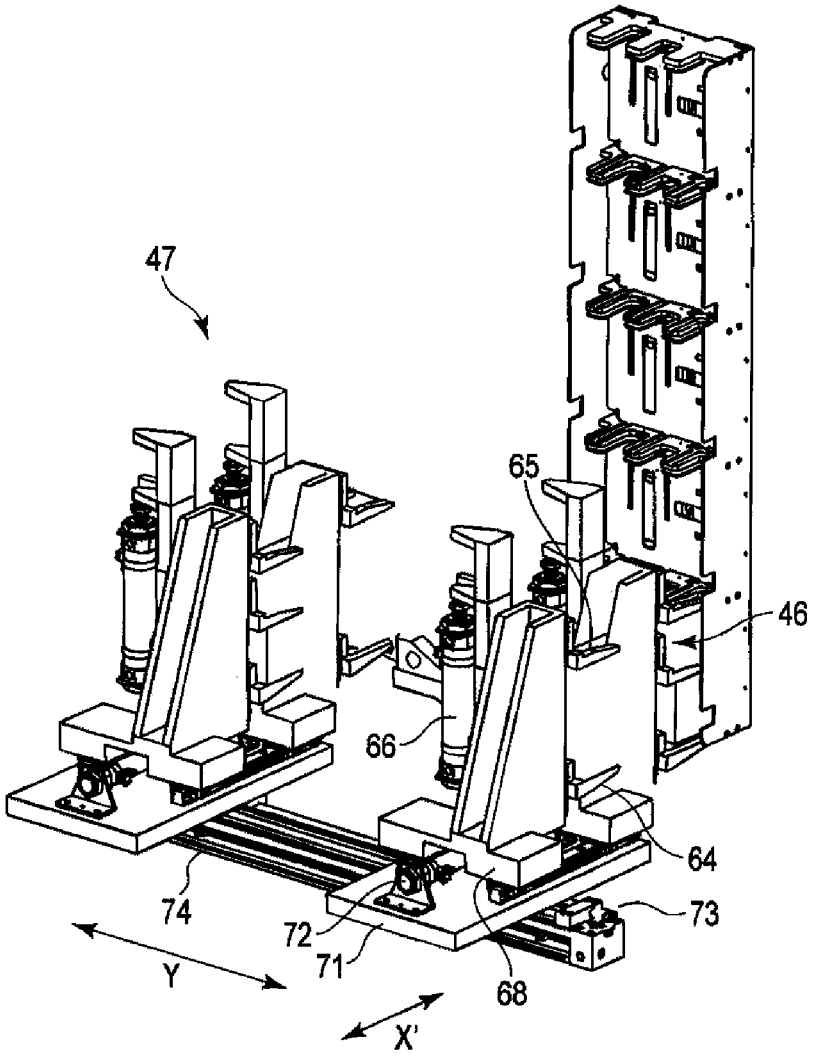
FIG. 20 is an appearance perspective view showing the grip arm and the transferring structure of the sheet insert device of FIG. 5.

As shown in FIG. 20, the grip arm 46 has a lower arm 64 which is to be inserted into the lower side of the loose sheets contained in each of the containing portions 51 of the cassette 41, and an upper arm 65 which is to be inserted into the upper side of the relevant loose sheets, so as to sandwich the loose sheets with this lower arm 64. Each of the lower arm 64 and the upper arm 65 has the claw 46*a* which becomes in the state of a nest with the above-described cutout 52*a* of the partition plate 52 of the cassette 41. The lower arm 64 and the upper arm 65 are operated so that they are closed in the direction to approach to each other, or are opened in the direction to separate from each other, by an air cylinder 66.

In the state that the cassette 41 is arranged at the uprising position T2 by the inverting structure 44, the containing portion 51 at the lowest end is arranged at a pulling-out position. The grip arm 46 arranges the lower arm 64 at a position where the lower arm 64 can be inserted into the cassette 41, so that the upper face of the claw 46*a* is positioned slightly lower than the upper face at the containing portion side of the partition plate 52 of the containing portion 51 of the lowest end arranged at the pulling-out position. At this time, the upper arm 65 is arranged at a position where the upper arm 65 can be inserted below (at the relevant containing portion side) the partition plate 52 of the upper end of the relevant containing portion 51.

The lower arm 64 and the upper arm 65 of the grip arm 46 are moved toward the containing portion 51 at the pulling-out position by the transferring structure 47, and are inserted inside the cassette 41. At this time, the moving direction of the grip arm 46 becomes a direction which tilts obliquely downward from the front toward the back of the device. That is, since the reference plane of the relevant device is tilted as described above, the upper face of the lower arm 64 and the lower face of the upper arm 65 of the grip arm 46 extend in a direction tilted downward at about 15° to the horizontal plane.

Since the lower arm 64 and the upper arm 65 are arranged at the above-described positions in the state that the cassette 41 is arranged at the uprising position T2, when the grip arm 56 is advanced by the transferring structure 47, and the arms 64, 65 are inserted into the cassette 41, the grip arm 56 becomes in the state capable of gripping the loose sheets contained in the containing portion 51 arranged at the pulling-out position. In this state, the lower arm 64 does not contact with the lower end of the loose sheets, and also the upper arm 65 becomes in the state separated upward from the loose sheets.

After this, when the air cylinder 66 is operated to close the grip arm 46, the upper face of the lower arm 64 slightly exceeds the loading plane of the bottom wall 52 and comes in contact with the loose sheets, and the upper arm 65 is lowered by a prescribed distance, so that the upper arm 65 sandwiches the relevant loose sheets with the lower arm 64. At this time, the claw 46*a* of the lower arm 64 is inserted into the cutout 52*a* of the partition plate 52 in the state of a nest.

By this means, the loose sheets contained in the containing portion 51 arranged at the pulling-out position are gripped by the grip arm 46. By gripping the loose sheets in this manner, the grip arm 46 can firmly clamp a plurality of the sheets P in the state that the sheets P are compressed along the stacking direction, accordingly, even if the grip arm 46 is moved after that, there may be hardly any worry that the loose sheets fall off.

Figure 21:
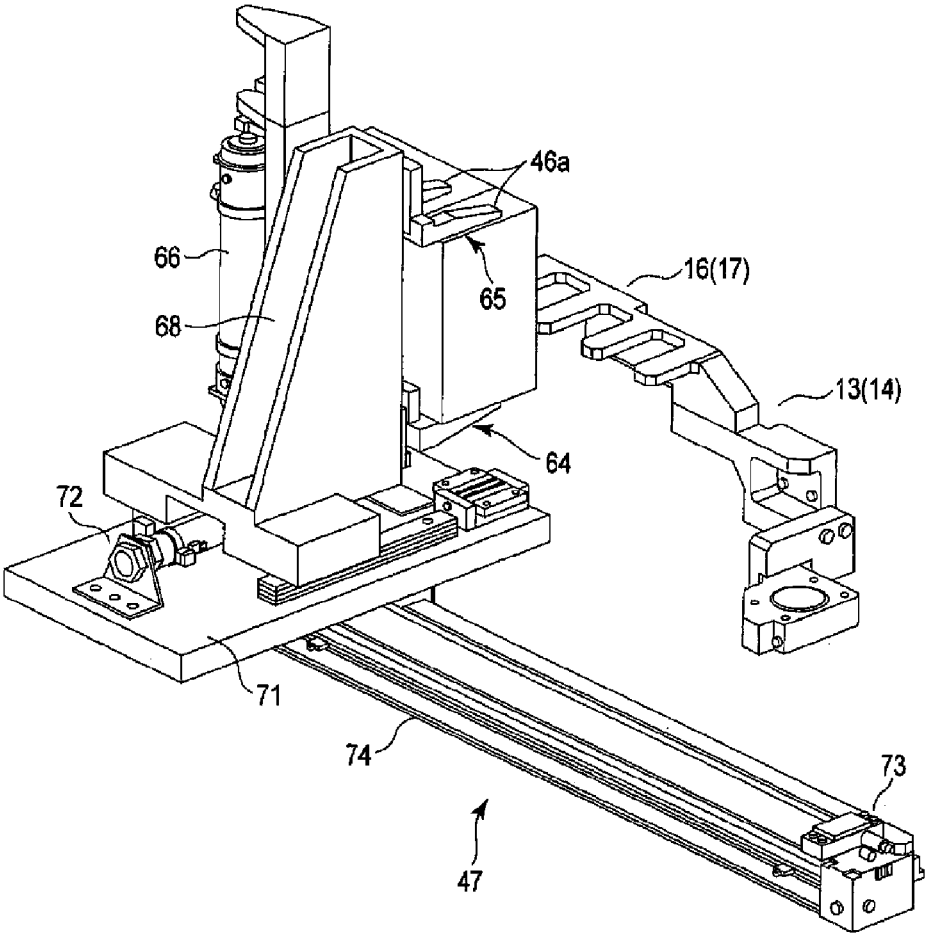
FIG. 21 is a diagram for explaining an operation of the transferring structure of the sheet insert device of FIG. 5.

As shown in FIG. 20 and FIG. 21, the transferring structure 47 has an air cylinder 72 to move a frame 68 to which the grip arm 46 is attached, in a front-back direction (X' direction) which is tilted against a slide stage 71, and an air cylinder 73 to move the slide stage 71 in the horizontal direction (Y direction). The X' direction described here indicates a direction which is tilted downward at about 15° from the front toward the back of the device.

That is, at the time of moving the grip arm 46 in the tilted front-back direction (X' direction), the air cylinder 72 is operated, to move the frame 68 of the grip arm 46 against the slide stage 71. In addition, at the time of moving the grip arm 46 in the horizontal direction (Y direction), the air cylinder 73 is operated, to move the slide stage 71 along a slide rail 74.

Figure 22:
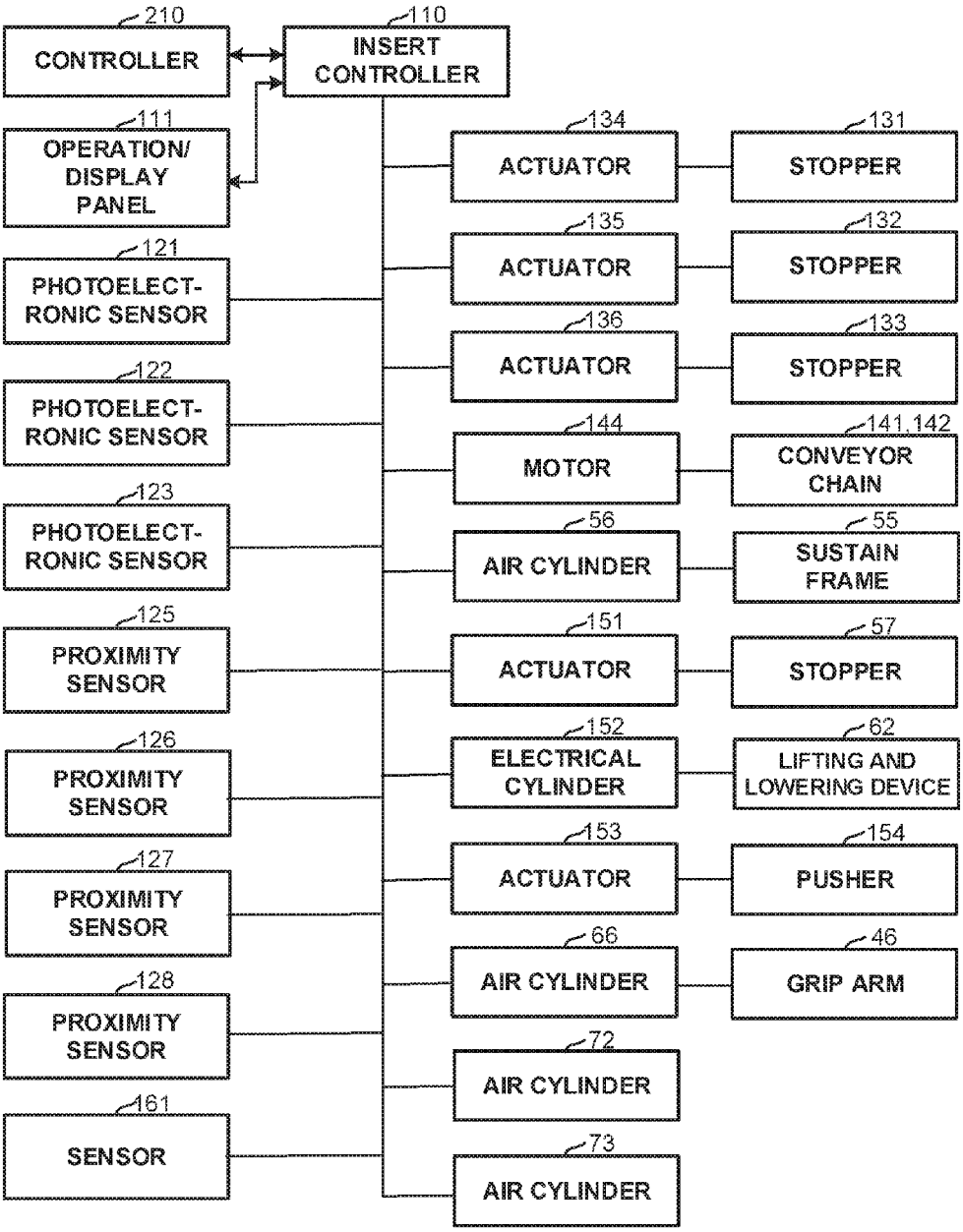
FIG. 22 is a block diagram of a control system to control an operation of the sheet insert device of FIG. 5.

Next, a control system to control an operation of the above-described insert device 100 will be described with reference to a block diagram shown in FIG. 22. A controller 210 to control an operation of the processing device 200 is connected to an insert controller 110 to control an operation of the insert device 100, through an interface not shown. In addition, an operation/display panel 111 which displays various operation information for an operator, and accepts various operation inputs by an operator is connected to the insert controller 110.

In addition, three transmission type photoelectronic sensors 121, 122, 123, and four reflection type proximity sensors 125, 126, 127, 128, so as to detect the cassette 41 set on the insert table 42 are connected to the insert controller 110.

Each of the photoelectronic sensors 121-123 has respective pairs of a light emitting part and a light receiving part which are respectively provided forward and backward in the device across the insert table 42, and thereby optical axes between the light emitting parts and the light receiving parts are respectively provided at positions extending in the front-back direction along the upper face of the insert table 42. And each of the photoelectronic sensors 121-123 detects that the object to be detected (the cassette 41 and the loose sheets) blocks the optical axis (sensor output OFF), to thereby detect the presence or absence of the object to be detected.

Each of the proximity sensors 125-128 is provided together with a light emitting part and a light receiving part, and makes a light emitted from the light emitting part to be reflected by an object to be detected, and receives the reflected light at the light receiving part, to thereby detect the presence or absence of the object to be detected. The proximity sensors 125-128 of the present embodiment are embedded in the insert table 42, and detect the lower end face of the cassette 41 (or loose sheets) which is conveyed along the insert table 42.

The first photoelectronic sensor 121 along the conveying direction is arranged near an end portion of the insert table 42 at the upstream side in the conveying direction, and detects a direction of the cassette 41 inserted on the insert table 42. The second photoelectronic sensor 122 and the third photoelectronic sensor 123 are arranged separately from each other at the downstream side of the first photoelectronic sensor 121 in the conveying direction.

In addition, the proximity sensor 125 is provided at the upstream end of the insert table 42 in the conveying direction, and the proximity sensor 126 is arranged between the detection positions by the two photoelectronic sensors 121, 122. In addition, the other two proximity sensors 127, 128 are separately provided backward and forward at the side opposite to the insert table 42 across the inverting structure 44.

In addition, actuators 134, 135, 136, such as solenoids, for respectively driving three stoppers 131, 132, 133 which are provided projectably and retractably from and into the upper face of the insert table 42 are connected to the insert controller 110.

The stopper 131 projects upward from the insert table 42 so as to inhibit the conveyance of the cassette 41 inserted into the end portion of the insert table 42 at the upstream side. The stopper 132 has two projections arranged separately at the front and back of the device, and makes the two projections to be operated simultaneously, to stop the cassette 41 which has been conveyed across the stopper 131. The stopper 133 is provided at the end portion of the insert table 42 at the downstream side in the conveying direction, and functions to stop the cassette 41 in front of the inverting structure 44.

In addition, a motor 144 so as to make endless conveyor chains 141, 142 run for conveying the cassette 41 along the insert table 42 is connected to the insert controller 110. Each of the two endless conveyor chains 141, 142 is arranged at a position where at least a portion thereof is exposed on the upper face of the insert table 42, and the exposed portion runs along the conveying direction. The two conveyor chains 141, 142 respectively run on positions separately at the front and back of the device.

Figure 8:
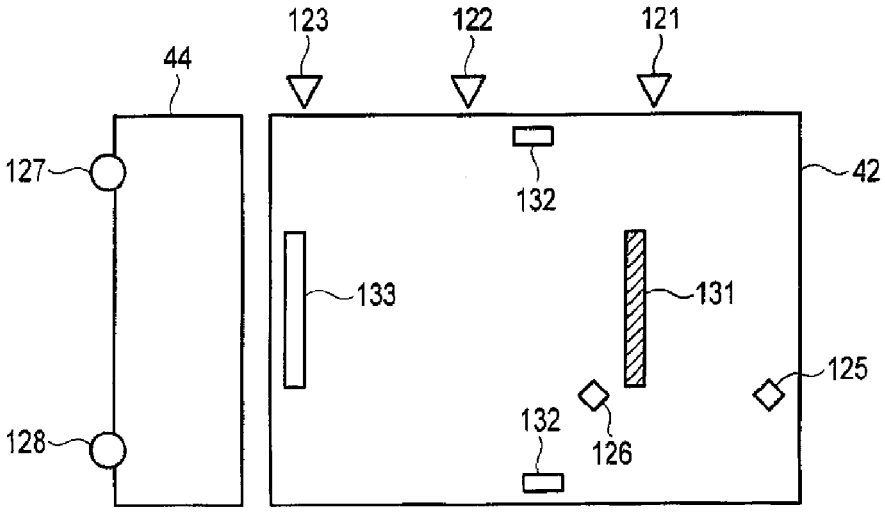
FIG. 8 is a diagram for explaining an operation of the conveying structure of the sheet insert device of FIG. 5.

In addition, the air cylinder 56 to rotate the sustain frame 55 of the inverting structure 44 between the loading position T1 and the uprising position T2, an actuator 151, such as a solenoid, to drive the stopper 57 which sustains the cassette 41 so that the cassette 41 does not slide down, at the time of rotating the sustain frame 55 toward the uprising position T2, an electrical cylinder 152 so as to make the lifting and lowering device 62 of the moving structure 45 operate, an actuator 153 so as to drive a pusher 154 for pushing out the vacant cassette 41 which has been moved to the lower position T3 by the moving structure 45, to the cassette discharger 48, the air cylinder 66 so as to drive the lower arm 64 and the upper arm 65 of the grip arm 46, the air cylinder 72 to make the frame 68 to which the grip arm 46 is attached slide in the back and forward direction, and the air cylinder 73 to make the slide stage 71 of the transferring structure 47 slide from side to side along the slide rail 74, are connected to the insert controller 110, Next, an operation of the above-described insert device 100 will be described. To begin with, the motor 144 of the conveying structure 43 is energized by the insert controller 110, and thereby the running of the two conveyor chains 141, 142 is started. Simultaneously, the actuator 134 is energized by the insert controller 110, and the stopper 131 is made to project from the insert table 42, as shown in FIG. 8.

In this state, the first cassette 41 containing loose sheets in each of the five containing portions 51 is inserted on the insert table 42 at the upstream side of the stopper 131 in the conveying direction. At this time, the insert controller 110 monitors outputs of the photoelectronic sensor 121 and the proximity sensor 125, to judge whether or not the relevant cassette 41 has been inserted on the insert table 42 in a normal posture.

Figure 9:
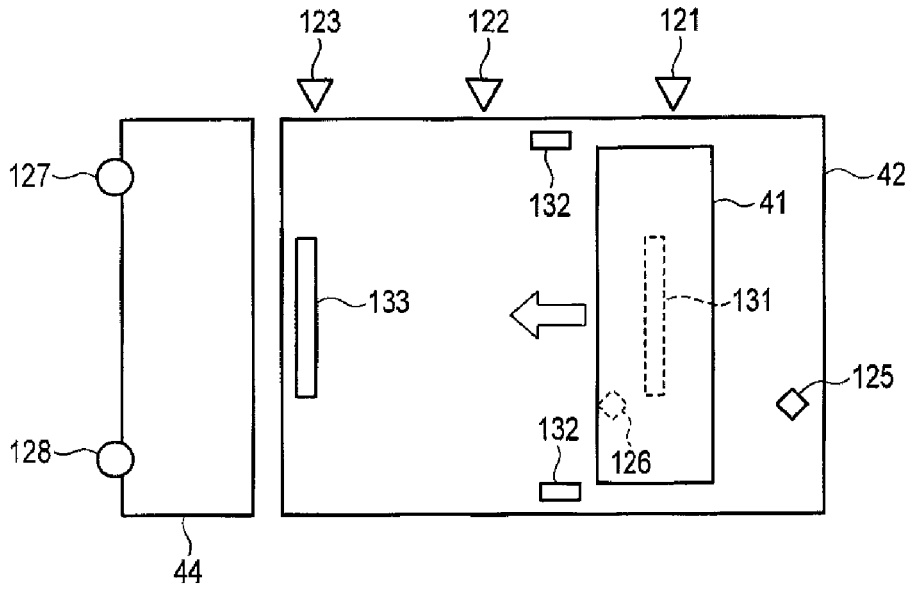
FIG. 9 is a diagram for explaining an operation of the conveying structure of the sheet insert device of FIG. 5.

That is, the insert controller 110 judges that the relevant cassette has been inserted in a normal posture, by the matter that the photoelectronic sensor 121 and the proximity sensor 125 both have detected the relevant cassette 41, and houses the stopper 131 in the insert table 42. By this means, the conveyance of the first cassette 41 is started, as shown in FIG. 9.

In addition, when the cassette 41 is not detected by the photoelectronic sensor 121 and the proximity sensor 125 after the cassette 41 is inserted, the insert controller 110 judges that the inserted posture of the relevant cassette 41 is not proper, and without housing the stopper 131, makes "an erroneous insertion pilot lamp" not shown of the operation/display panel 111 to be lighted, to notify an operator of the matter.

Figure 10:
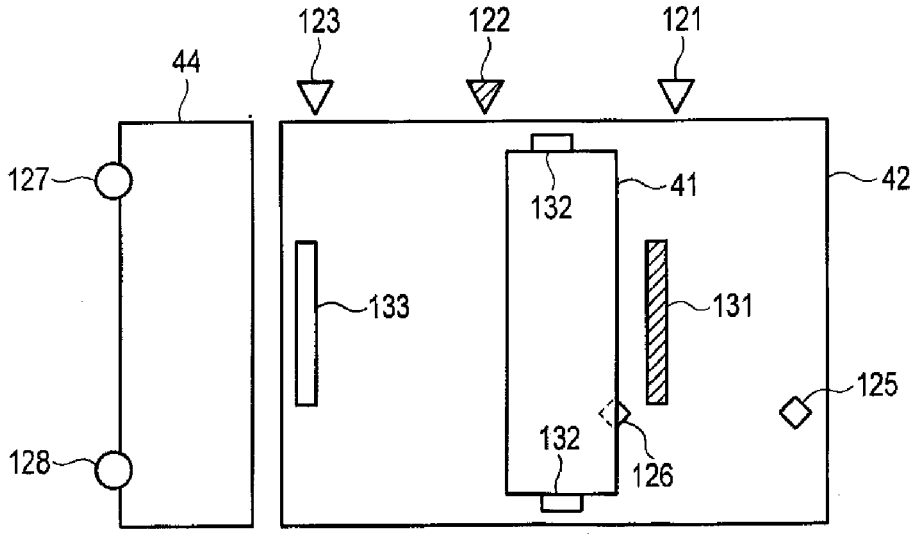
FIG. 10 is a diagram for explaining an operation of the conveying structure of the sheet insert device of FIG. 5.

When the conveyance of the first cassette 41 across the stopper 131 is started, the insert controller 110 monitors an output of the second photoelectronic sensor 122 along the conveying direction. And when the relevant cassette 41 blocks an optical axis of the photoelectronic sensor 122, as shown in FIG. 10, the insert controller 110 makes the stopper 131 at the most upstream side project from the upper face of the insert table 42, and makes "an insertion ready pilot lamp" not shown of the operation/display panel 111 to be lighted.

Figure 11:
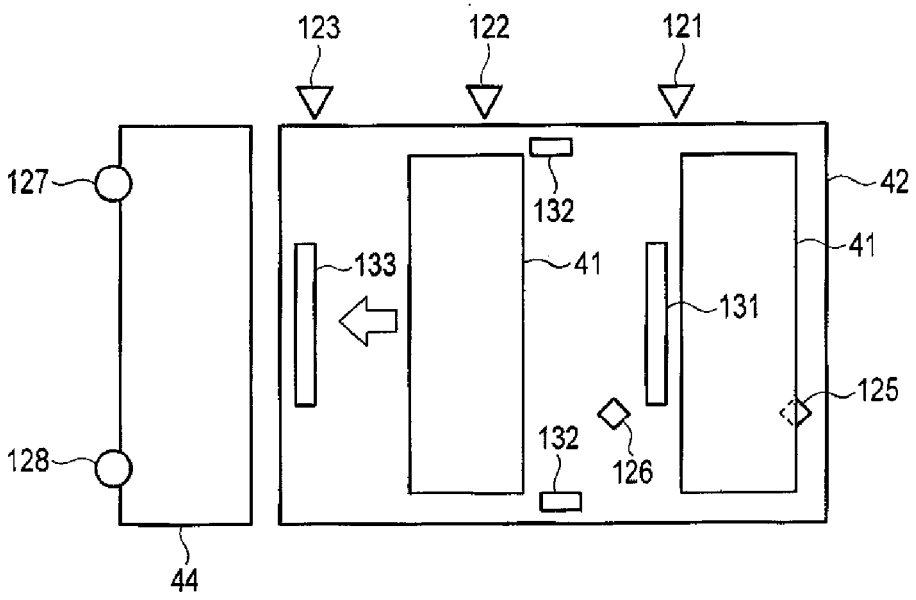
FIG. 11 is a diagram for explaining an operation of the conveying structure of the sheet insert device of FIG. 5.

In this state, the insert controller 110 continues to make the stopper 131 project, till the first cassette 41 is transferred to the loading position T1 of the inverting structure 44. That is, even when it is judged that the inserted posture of the second cassette 41 inserted next at the upstream side of the stopper 131 is proper, for example, the insert controller 110 does not house the stopper as shown in FIG. 11, till the first cassette 41 is transferred to the inverting structure 44.

Figure 12:
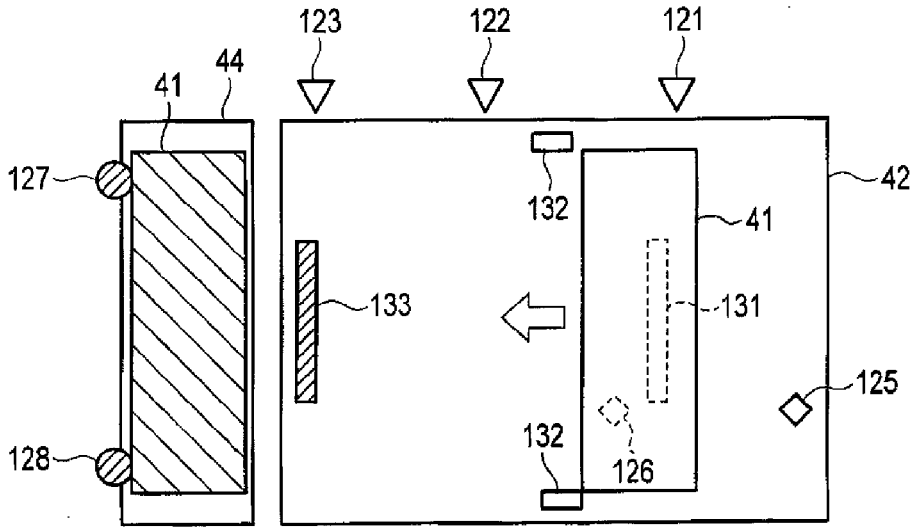
FIG. 12 is a diagram for explaining an operation of the conveying structure of the sheet insert device of FIG. 5.

After this, the insert controller 110 monitors outputs of the two proximity sensors 127, 128 provided at the inverting structure 44. And, when the proximity sensors 127, 128 detect the first cassette 41, as shown in FIG. 12, the insert controller 110 judges that the relevant first cassette 41 has been conveyed to the inverting structure 44, houses the stopper 131 in the insert table 42, and starts the conveyance of the second cassette 41.

Simultaneously, after the first cassette 41 has been transferred to the inverting structure 44, the insert controller 110 energizes the actuator 136, to make the stopper 133 provided at the downstream side (immediately before the inverting structure 44) of the insert table 42 project from the insert table 42, under the condition that the cassette 41 is not detected by the photoelectronic sensor 123.

Furthermore, the insert controller 110 simultaneously makes the air cylinder 56 operate, to make the sustain frame 55 of the inverting structure 44 rotate upward from the loading position T1, and starts a raising operation of the first cassette 41. In addition, the insert controller 110 does not make the inverting structure 44 operate, unless the stopper 133 is in a projected state.

Figure 13:
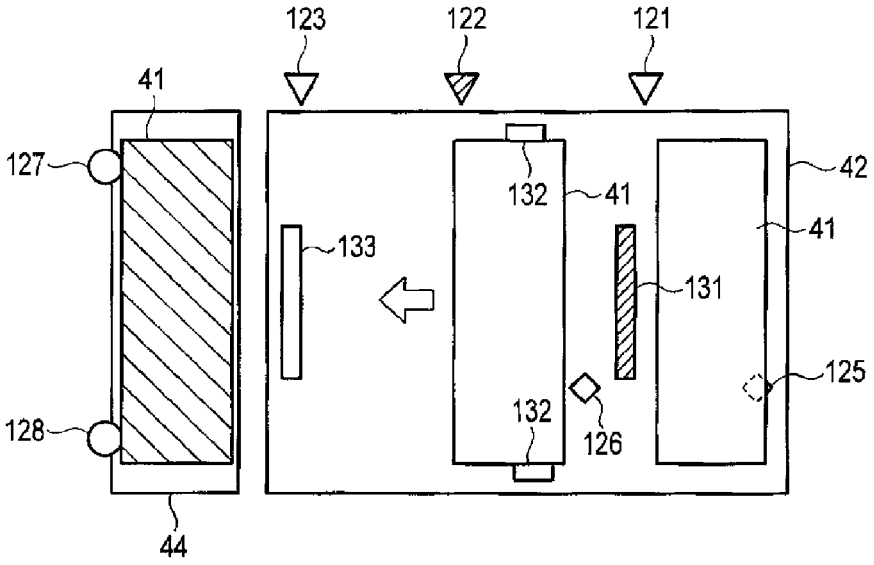
FIG. 13 is a diagram for explaining an operation of the conveying structure of the sheet insert device of FIG. 5.
Figure 14:
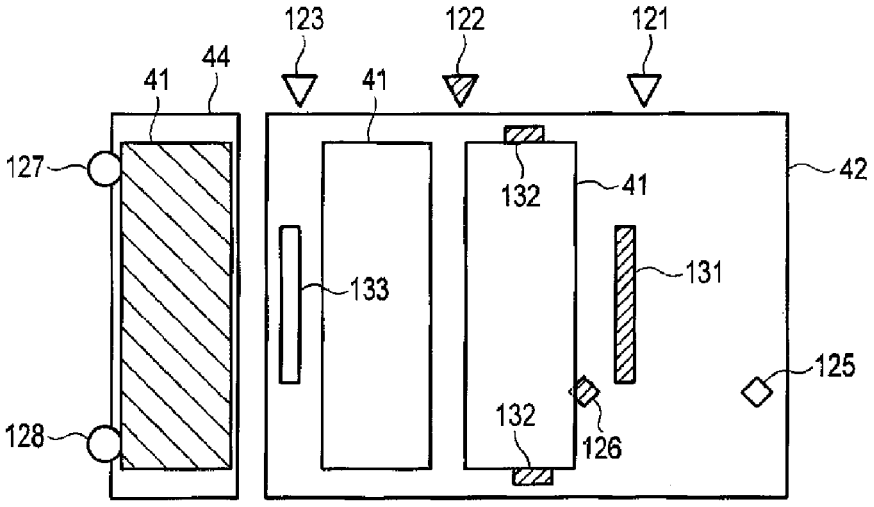
FIG. 14 is a diagram for explaining an operation of the conveying structure of the sheet insert device of FIG. 5.

After starting the raising operation of the first cassette 41, the insert controller 110 monitors an output of the photoelectronic sensor 122. And, when the photoelectronic sensor 122 detects the second cassette 41, as shown in FIG. 13, the insert controller 110 makes the stopper 131 project from the insert table 42, and makes "the insertion ready pilot lamp" of the operation/display panel 111 to be lighted. By this means, the third cassette 41 is loaded on the insert table 42 in front of the stopper 131 (FIG. 13).

Here, when the photoelectronic sensor 122 detects the second cassette 41, the stopper 131 is once made to project, but in case that there is a space enough to further transfer the third cassette 41 to the downstream side as shown in FIG. 13, it is not necessary to make the stopper 131 project. In any case, the second cassette 41 is conveyed without change and is stopped by the stopper 133.

After this, the insert controller 110 detects the third cassette 41 through the second photoelectronic sensor 122 and the second proximity sensor 126, before the third cassette 41 reaches the second cassette 41, and makes the second paired stoppers 132, 132 operate. By this means, the third cassette 41 is stopped before reaching the second cassette 41.

In addition, at this time, the insert controller 110 makes the stopper 131 project from the insert table 42, and makes "the insertion ready pilot lamp" of the operation/display panel 111 to be lighted. By this means, it becomes possible to insert the fourth cassette 41.

Figure 15:
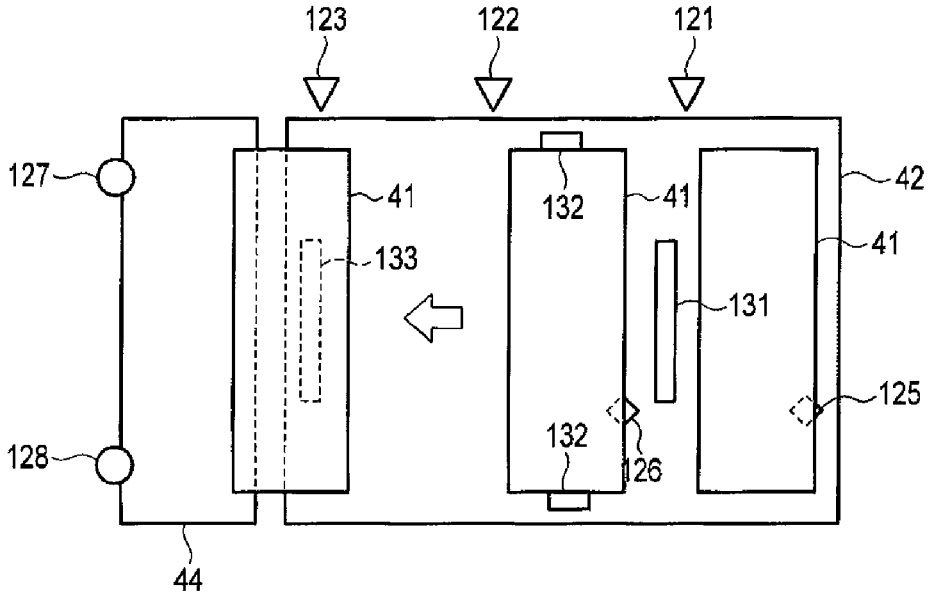
FIG. 15 is a diagram for explaining an operation of the conveying structure of the sheet insert device of FIG. 5.

After the whole loose sheets are taken out from the first cassette 41, the first cassette 41 is discharged from the inverting structure 44, and the sustain frame 55 is returned to the approximately horizontal loading position T1, the insert controller 110 houses the stopper 133 in the insert table 42, as shown in FIG. 15, and resumes the conveyance of the second cassette 41, and transfers the second cassette 41 to the inverting structure 44. FIG. 15 shows the state that the fourth cassette 41 is inserted on the insert table 42.

At this time, the third cassette 41 is in the state to be stopped by the stoppers 132, 132, and the fourth cassette 41 is also in the state to be stopped by the stopper 131 at that place.

Figure 16:
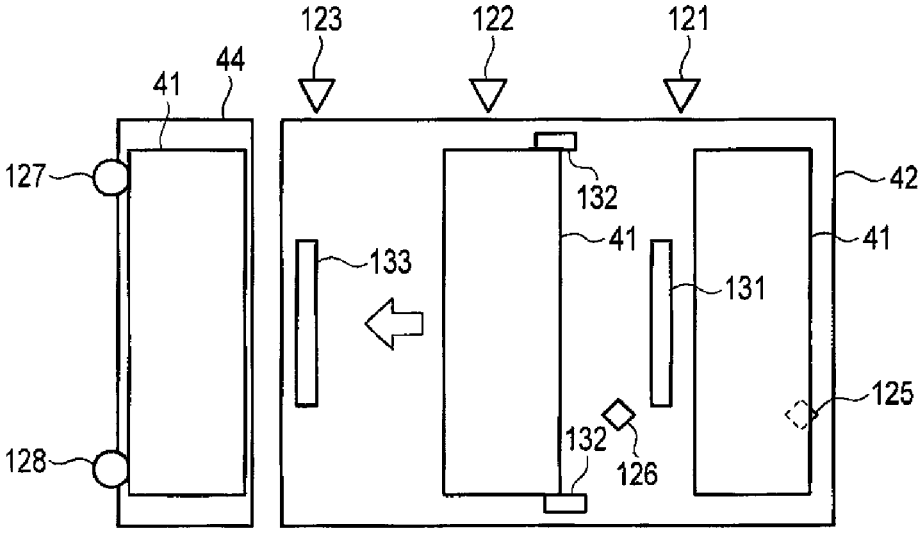
FIG. 16 is a diagram for explaining an operation of the conveying structure of the sheet insert device of FIG. 5.

After this, the insert controller 110 monitors outputs of the proximity sensors 127, 128 positioned at the inverting structure 44, and judges whether or not the second cassette 41 has been transferred to the loading position T1 of the inverting structure 44. And when judging that the second cassette 41 has been transferred to the inverting structure 44, the insert controller 110 makes the stopper 133 project, as shown in FIG. 16, and releases the restraint of the third cassette 41 by the stoppers 132, 132. By this means, the conveyance of the third cassette 41 is resumed. At this time, the second cassette 41 is made to start the raising operation by the inverting structure 44.

Figure 17:
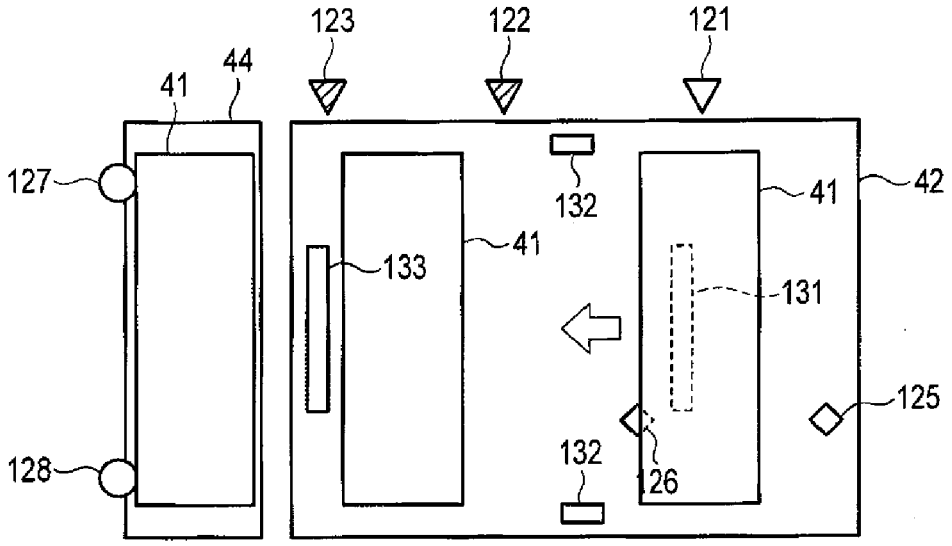
FIG. 17 is a diagram for explaining an operation of the conveying structure of the sheet insert device of FIG. 5.

And, when the second photoelectronic sensor 122 detects the passing of the third cassette 41, or the third photoelectronic sensor 123 detects the third cassette 41, the insert controller 110 houses the stopper 131 in the insert table 42, as shown in FIG. 17, and starts the conveyance of the fourth cassette 41.

As described above, when the cassette 41 is conveyed to the inverted position T1 by the conveying structure 43, the insert controller 110 makes the actuator 151 operate, to make the stopper 57 project from the sustain frame 55. After this, the insert controller 110 makes the air cylinder 56 of the inverting structure 44 operate, to make the sustain frame 55 to be raised. At this time, the stopper 57 is engaged with the lower end of the cassette 41, and thereby prevents the cassette 41 from sliding down along the sustain frame 55.

When the cassette 41 is arranged at the uprising position T2 by the inverting structure 44, the containing portion 51 at the lowest end is automatically arranged at the pulling-out position. At the front side of the pulling-out position, the grip arm 45 stands by. When the grip arm 46 is in this stand-by state, the lower arm 64 and the upper arm are opened. The cassette 41 arranged at the uprising position T2 is tilted backward at an angle of 75°.

In addition, at the lower end of the cassette 41 arranged at the uprising position T2, the sustain arm 61 of the moving structure 45 stands by. For this reason, after raising the cassette 41 to the uprising position T2, the insert controller 110 houses the stopper 57, and transfers the cassette 41 to the sustain arm 61 by making the cassette 41 slightly fall down by its own weight.

After transferring the cassette 41 to the sustain arm 61 of the moving structure 45, the insert controller 110, makes the air cylinder 72 of the transferring structure 47 operate, to insert the grip arm 46 into the housing portion 51 at the lowest end positioned at the pulling-out position of the grip arm 46, in the state that the back face side of the cassette 41 is put on the sustain frame 55 of the inverting structure 44. In this state, the insert controller 110 makes the air cylinder 66 operate, to close the lower arm 64 and the upper arm 65 of the grip arm 46, and to grip the loose sheets of the containing portion 51.

After this, the insert controller 110 makes the air cylinder 72 of the transferring structure 47 operate, to pull out the grip arm 46 in the state to grip the loose sheets from the containing portion 51 to the front side. And the insert controller 110 makes the air cylinder 73 operate, to make the grip arm 46 to be moved in the left direction toward the sheet loading part 2 of the processing device 200. Furthermore, the insert controller 110 makes the air cylinder 72 of the transferring structure 47 operate, to insert the grip arm 46 into the sheet loading part 2 of the processing device 200.

While the grip arm 46 moves to the sheet loading part 2 after gripping the loose sheets, since the loose sheets are sandwiched in the state to be compressed along the stacking direction of a plurality of the sheets P, there is hardly any worry that the loose sheets fall off from the grip arm 46.

At the receiving position A inside the processing device 200 to which the grip arm 46 is inserted as described above, the first feeder paddle 16 of the first feeder paddle unit 13, or the second feeder paddle 17 of the second feeder paddle unit 14 stands by, as shown in FIG. 21. Here, it is temporarily supposed that the first feeder paddle 16 stands by.

The insert controller 110 opens the lower arm 64 and the upper arm 65 of the grip arm 46, in the state that the loose sheets gripped by the grip arm 46 are inserted on the upper side of the first feeder paddle 16. At this time, the claw 46*a* of the lower arm 64 and the claw of the first feeder paddle 16 are arranged in the state of a nest, and the loose sheets are transferred onto the first feeder paddle 16.

After this, the insert controller 110 controls the transferring structure 47 again, to pull out the grip arm 46 in the state that the two arms 64, 65 are opened from the sheet loading part 2, and to return the grip arm 46 to the stand-by position, so as to receive next loose sheets.

While the loose sheets of the containing portion 51 at the lowest end of the cassette 41 are transferred to the processing device 200, as described above, the insert controller 110 makes the moving structure 45 operate, to lower the cassette 41 in the state that the loose sheets have been pulled out from the containing portion 51 at the lowest end, by the height of the containing portion 51. By this means, the second containing portion 51 from the bottom is arranged at the pulling-out position next time.

After the loose sheets have been pulled out from the all containing portions 51 of the cassette 41 in the same manner, the insert controller 110 makes the actuator 153 operate, to make the pusher operate, and to discharge the vacant cassette 41 which has been lowered to the lower position T3 to the cassette discharger 48.

After this, the insert controller 110 makes the lifting and lowering structure 62 operate, to return the sustain frame 55 to the approximately horizontal loading position T1 for processing the next cassette 41, and to lift and return the sustain arm 61 of the moving structure 45 to the stand-by position for receiving the next cassette 41.

By repeating the above-described operation, the loose sheets are sequentially taken out from the cassette 41 which is supplied through the insert table 42, and inserted into the sheet loading part 2 of the processing device 200. Though, depending on the processing ability of the processing device 200, it is possible to continuously insert the loose sheets into the processing device 200, by using this insert device 100.

According to the sheet insert device and the sheet processing apparatus of the above-described embodiment, since the loose sheets contained in the containing portion 51 of the cassette 41 are gripped by the grip arm 46 in the stacking direction, and this grip arm 46 is inserted into the sheet loading part 2 of the processing device 200 without changing the posture, it is possible to surely, without falling off, insert the loose sheets in the state that a plurality of the sheets P are stacked.

In particular, according to the present embodiment, since a plurality of the sheets P (loose sheets) which are stacked in the gravity direction are sandwiched by the grip arm 46 in the vertical direction, and without moving the grip arm 46 in the vertical direction, and without rotating the grip arm 46, but the grip arm 46 is only moved along the approximately horizontal plane, an undesired force such as to make the loose sheets gripped by the grip arm 46 fall off is hardly applied.

In addition, according to the insert device 100 of the present embodiment, since loose sheets can be housed in the cassette 41 in an uprising state on a work bench which is different from the device, it is possible to improve workability, and a malfunction such as to fall off the loose sheets can practically be eliminated. In addition, even when the sheet P falls off at the time of housing the sheets P in the cassette 41, it is possible to easily return the fallen sheet P into the cassette 41.

Furthermore, when the insert device 100 of the present embodiment is used, since it becomes unnecessary to insert loose sheets into the sheet loading part 2 of the processing device 200 by manual work of an operator, work load by an operator can greatly be reduced, and it is possible to surely insert a plurality of the sheets P into the sheet loading part 2. In addition, loose sheets are once housed in the cassette 41, and thereby it is possible to inspect the loose sheets to be inserted into the processing device 200.

While certain embodiments have been described, these embodiments have been presented by way of example only, and are not intended to limit the scope of the inventions. Indeed, the embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet insert device comprising:

a cassette having a plurality of containing portions each of which contains a plurality of sheets in a vertically stacked state;

a moving structure to move the cassette so that the plurality of containing portions are arranged in turn at a pulling-out position;

a grip arm to grip the plurality of sheets contained in the containing portion arranged at the pulling-out position in a stacking direction; and a transferring structure which moves the grip arm, to pull out the plurality of sheets at the pulling-out position which are gripped by the grip arm from the containing portion, and transfers the plurality of sheets to a sheet loading part without changing the posture;

an inverting structure to raise the cassette from a first posture in which the containing portion contains the plurality of sheets in an uprising state, to a second posture in which the plurality of sheets contained in the containing portion are vertically stacked.

2. The device of claim 1, wherein the cassette includes:

a plurality of partition plates which partition the cassette so as to compose the plurality of containing portions;

a backboard to which one end edges of the sheets in a longitudinal direction contact, when the plurality of sheets are vertically stacked;

a pair of side panels which are provided at both sides of the backboard, and to which both end edges of the sheets in a wide direction respectively contact, when the plurality of sheets are vertically stacked; and wherein the plurality of partition plates have each a cutout of a comb teeth shape to pass a claw formed on the grip arm.

3. The device of claim 1, wherein the grip arm includes:

a lower arm configured to be arranged at a bottom wall of the containing portion arranged at the pulling-out position; and an upper arm which is provided vertically movably so as to sandwich the plurality of sheets of the containing portion with the lower arm.

4. The device of claim 1, wherein the second posture is a posture in which the cassette is tilted at a prescribed angle, and the inverting structure raises the cassette so that the cassette is tilted at the prescribed angle.

5. The device of claim 1, wherein the inverting structure includes:

a sustain frame to load the cassette and slidably sustain the cassette; and a rotary shaft to rotatably sustain the sustain frame.

6. The device of claim 1, further comprising:

an accepting portion to accept a plurality of the cassettes in the first posture; and a conveying structure to sequentially convey the cassettes from the accepting portion to an inverted position of the cassette by the inverting structure.

7. The device of claim 1, wherein the transferring structure includes:

a frame to which the grip arm is attached;

a first air cylinder to move the frame in a first direction which is tilted against a slide stage; and a second air cylinder to move the slide stage in a second direction orthogonal to the first direction.

8. A sheet processing apparatus comprising:

a cassette having a plurality of containing portions each of which contains a plurality of sheets in a vertically stacked state;

a moving structure to move the cassette so that the plurality of containing portions are arranged in turn at a pulling-out position;

a grip arm to grip the plurality of sheets contained in the containing portion arranged at the pulling-out position in a stacking direction;

a transferring structure which moves the grip arm, to pull out the plurality of sheets at the pulling-out position which are gripped by the grip arm from the containing portion, and transfers the plurality of sheets to a sheet loading part without changing the posture; and an inspection portion to take out the plurality of sheets transferred to the sheet loading part by the transferring structure one by one and inspect the sheet;

an inverting structure to raise the cassette from a first posture in which the containing portion contains the plurality of sheets in an uprising state, to a second posture in which the plurality of sheets contained in the containing portion are vertically stacked.

9. The apparatus of claim 8, wherein the cassette includes:

a plurality of partition plates which partition the cassette so as to compose the plurality of containing portions;

a backboard to which one end edges of the sheets in a longitudinal direction contact, when the plurality of sheets are vertically stacked;

a pair of side panels which are provided at both sides of the backboard, and to which both end edges of the sheets in a wide direction respectively contact, when the plurality of sheets are vertically stacked; and wherein the plurality of partition plates have each a cutout of a comb teeth shape to pass a claw formed on the grip arm.

10. The apparatus of claim 8, wherein the grip arm includes:

a lower arm configured to be arranged at a bottom wall of the containing portion arranged at the pulling-out position; and an upper arm which is provided vertically movably so as to sandwich the plurality of sheets of the containing portion with the lower arm.

11. The apparatus of claim 8, wherein the second posture is a posture in which the cassette is tilted at a prescribed angle, and the inverting structure raises the cassette so that the cassette is tilted at the prescribed angle.

12. The apparatus of claim 8, wherein the inverting structure includes:

a sustain frame to load the cassette and slidably sustain the cassette; and a rotary shaft to rotatably sustain the sustain frame.

13. The apparatus of claim 8, further comprising:

an accepting portion to accept a plurality of the cassettes in the first posture; and a conveying structure to sequentially convey the cassettes from the accepting portion to an inverted position of the cassette by the inverting structure.

14. The apparatus of claim 8, wherein the transferring structure includes:

a frame to which the grip arm is attached;

a first air cylinder to move the frame in a first direction which is tilted against a slide stage; and a second air cylinder to move the slide stage in a second direction orthogonal to the first direction.

15. A sheet processing method comprising:

housing a plurality of sheets in a stacked state in respective containing portions of a plurality of the containing portions formed in a cassette;

moving the cassette so that the plurality of containing portions are arranged in turn at a pulling-out position;

gripping the plurality of sheets contained in the containing portion arranged at the pulling-out position in a stacking direction by a grip arm; and moving the grip arm which has gripped the sheets, to pull out the plurality of sheets at the pulling-out position which are gripped by the grip arm from the containing portion, and transferring the plurality of sheets to a sheet loading part without changing the posture;

raising the cassette from a first posture in which the containing portion contains the plurality of sheets in an uprising state, to a second posture in which the plurality of sheets contained in the containing portion are vertically stacked.

16. The method of claim 15, wherein the second posture is a posture in which the cassette is tilted at a prescribed angle.

17. The method of claim 15, further comprising:

taking out the plurality of sheets transferred to the sheet loading part one by one and inspecting the sheet; and sorting and stacking the sheets for each prescribed number of sheets based on the inspection result.

* * * * *